US006729832B1

(12) United States Patent
Word, III et al.

(10) Patent No.: US 6,729,832 B1
(45) Date of Patent: May 4, 2004

(54) APPARATUS TO EFFECTUATE RETRIEVAL, TRANSPORT AND POSITIONING OF CONFIGURATED PIPE-LIKE STRUCTURES

(76) Inventors: Thomas Nott Word, III, 6121 E. 105th St., Tulsa, OK (US) 74137; Steven Wayne Ohman, 29308 E. 70th St., Broken Arrow, OK (US) 74014

( * ) Notice: Subject to any disclaimer, the term of this patent is extended or adjusted under 35 U.S.C. 154(b) by 0 days.

(21) Appl. No.: 10/071,774

(22) Filed: Feb. 7, 2002

(51) Int. Cl.[7] ..... B66F 9/18
(52) U.S. Cl. ..... 414/729; 37/406; 294/104
(58) Field of Search ..... 414/729, 740, 414/785, 621, 622; 294/88, 104; 37/406

(56) References Cited

U.S. PATENT DOCUMENTS

| | | | | | |
|---|---|---|---|---|---|
| 3,608,950 | A | | 9/1971 | Westbrand | 294/88 |
| 4,285,628 | A | | 8/1981 | Jankowski | 414/739 |
| 4,407,626 | A | | 10/1983 | Bruckner | 414/740 |
| 4,529,239 | A | * | 7/1985 | Ogawa | 414/740 X |
| 4,718,815 | A | | 1/1988 | Lindgren | 414/729 |
| 4,897,014 | A | | 1/1990 | Tietze | 414/729 |
| 4,907,356 | A | | 3/1990 | Labounty | 37/117.5 |
| 4,932,832 | A | | 6/1990 | McCasland et al. | 414/732 |
| 5,328,223 | A | * | 7/1994 | Maggio | 294/88 X |
| 5,553,408 | A | | 9/1996 | Townsend | 37/406 |
| 5,639,205 | A | | 6/1997 | Kaczmarczyk et al. | 414/723 |
| 5,678,332 | A | | 10/1997 | Hawkins | 37/403 |
| 5,927,933 | A | | 7/1999 | Tucker | 414/729 |
| 6,260,294 | B1 | | 7/2001 | Pitcher | 37/406 |
| 6,287,072 | B1 | | 9/2001 | Wasilas | 414/729 |

* cited by examiner

*Primary Examiner*—Donald W. Underwood
(74) *Attorney, Agent, or Firm*—Head, Johnson and Kachigian

(57) ABSTRACT

In combination with a vehicle, a gripping apparatus comprising connected top, bottom, left, right, and intermediate support members; a brace support wall; a pivot bar positioned horizontally across the apparatus and extending through openings in left, right, and intermediate support members; a jaw housing having first and second lower jaw weld walls, and top, bottom, left and right members; concaved shaped left and right upper jaw members each pivotally attached to the pivot bar; concaved shaped left and right lower jaw members each having upper, lower, left and right side surfaces, with upper and lower surfaces immovably attached to a first lower jaw attachment wall and left and right surfaces immovably attached to the second lower jaw attachment wall; a lower right jaw brace impermanently attached to the pivot bar and immovably attached to the brace support wall; at least one lower left jaw brace impermanently attached to the pivot bar and immovably attached to the brace support wall; a first hydraulic cylinder attached to the upper left jaw and an internal lower jaw housing surface; and, a second hydraulic cylinder attached to said upper right jaw and an internal lower jaw housing surface.

8 Claims, 5 Drawing Sheets

APPARATUS TO EFFECTUATE RETRIEVAL, TRANSPORT AND POSITIONING OF CONFIGURATED PIPE-LIKE STRUCTURES

REFERENCE TO PENDING APPLICATIONS

This application is not related to any other pending applications.

REFERENCE TO MICROFICHE APPENDIX

This application is not referenced in any microfiche appendix.

TECHNICAL FIELD OF THE INVENTION

This invention generally relates to a device used for gripping objects. In particular, the invention relates to a gripping device useful in retrieving, transporting and positioning individual or configurated cylindrically shaped structures when removably attached to a forklift or other similarly intended vehicle employed in civil engineering applications.

BACKGROUND OF THE INVENTION

The invention is an apparatus which is removably attached to vehicles typically, though not limited to those employed in civil engineering operations. Examples of such vehicles would include forklifts and telescopic handlers, such as: Model 1054, 1052, 8042, and 6036 Skytrak Legacy Series, Telescopic Handlers, manufactured and distributed by the Omni Quip Corporation. Workers needing to retrieve, transport, and position generally cylindrically shaped configurated pipe-like structures are unable to use contemporary art civil engineering implements which are commonly attached to the above-noted vehicles, as such implements lack a plurality of radially accommodation, concaved shaped jaw pairs having dimensioned and configured to address the varying length, girth, and weight dimensions of configurated and singular pipe-like structures. As used herein, the term "configurated pipe-like structures" relates to single or joined pipe structures occurring along a single or multi-dimensional plane(s) of reference. It is difficult, if not impossible, to precisely retrieve, transport, and position such structures utilizing a vehicle equipped with civil engineering implements of the contemporary art.

The invention disclosed herein is based on the discovery that a plurality of concaved shaped lower and upper jaw member pairs may be hydraulicly operated and can be used in combination with a non-skid surface to retrieve a pipe-like cylindrically shaped structure from an absolute vertical position, rotate the structure upwardly approximately 110°, and allow gravity to assist the invention in retaining the pipe-like structure within its grasp allowing for its subsequent transport and positioning.

CROSS-REFERENCE RELATED TO PRIOR ART

For background information relating to the general subject matter oft his invention reference may be had to the following previously issued United States patents:

| U.S. Pat. No. | INVENTOR | TITLE |
|---|---|---|
| 3,608,950 | Karl Ivan Westbrand | Arrangement at Load Carrier |

-continued

| U.S. Pat. No. | INVENTOR | TITLE |
|---|---|---|
| | Ornskoldsvik | |
| 6,260,294 B1 | Warrick Stanley Pitcher | Grab Attachment for Backhoe and Excavator Buckets |
| 4,407,626 | Peter J. Bruckner | Gripping Device |
| 5,927,933 | William C. Tucker | Retractable Thumb |
| 4,932,832 | Thomas A. McCasland Danks Dr., Evergreen Gilbert L. Dunn, Jr. | Backhoe Gripping Attachment |
| 4,897,014 | Richard C. Tietze | Device for Interchange of Tools |
| 5,553,408 | Edward H. Townsend | Excavator Bucket Attachment |
| 6,287,072 B1 | James Wasilas | Precision Grapple |
| 4,285,628 | Edward M. Jarikowski | Grapple System |
| 4,718,815 | Kenneth Lindgren | Device for Carrying and Adjusting a Tool |
| 4,907,356 | Labounty | Slipper Bucket for Grapple |
| 5,553,408 | Townsend | Excavator Bucket Attachment |
| 5,639,205 | Kaczmarcyzak et al. | Parkable Grapple having Quick Attachment to Loader Holder |
| 5,678,332 | Hawkins | Changeable and Retractable Implement for Use on a Back Hoe and Method |

The instant invention as disclosed herein is not suggested in any prior, or in any combinations of prior art. Consequently, the prior art fails to anticipate the invention as disclosed and claimed herein.

BRIEF SUMMARY OF THE INVENTION

One form of the instant invention is removably attached to a vehicle having fittings to which civil engineering implements are removably attachable. The invention is found comprising: an accessory accommodation base having connected top, bottom, left, right, and intermediate support members; a brace support wall attached to the accessory accommodation base; a pivot bar positioned horizontally across the accessory accommodation base and extending through openings in left, right and intermediate support members; a jaw housing having connected first and second lower jaw weld walls and top, bottom, left and right members; concaved shaped left and right upper jaw members each pivotally attached to the pivot bar; concaved shaped left and right lower jaw members each having upper, lower, left and right side surfaces, said upper and lower surfaces immovably attached to the first lower jaw attachment wall and said left and right surfaces immovably attached to the second lower jaw attachment wall; a lower right jaw brace impermanently attached to the pivot bar and immovably attached to said brace support wall; at least one lower left jaw brace impermanently attached to said pivot bar and immovably attached to said brace support wall; a first hydraulic cylinder attached to said upper left jaw and an internal lower jaw housing surface; and, a second hydraulic cylinder attached to said upper right jaw and an internal lower jaw housing surface. A third hydraulic cylinder is optimally attached to said top and bottom support members to allow for the left/right inclined orientation of the accessory accommodation base.

Alternate forms and objects of the invention will be comprehended in the drawings and description, which will make other alternate forms and objects obvious hereafter to persons skilled in the art. These and other advantages, features, and objects of the invention will become more apparent from the following description taken in connection with the illustrative embodiment in the accompanying drawings.

A broad object of the invention is to provide, in combination with a vehicle having an accessory accommodation base to which devices are removably attachable, is a gripping apparatus which may be used to effectuate the retrieval, transport, and positioning of configurated pipe-like structures.

An additional object of the instant invention is to provide a gripping apparatus which may be appropriately dimensioned to handle any number of diverse configurated pipe-shaped structures and weight/lengths.

A further object of the instant invention is to provide a gripping apparatus which may be independently rotated from absolute vertical to approximately 110° to allow gravity to assist in restricting a pipe-like structure once grasped by the apparatus from rotating.

Another object of the instant invention is to provide a gripping apparatus whereby rubber or other non-slipping surfaces on the invention's gripping jaws may be utilized to work in conjunction with gravity to restrict a cylindrical structure from rotating once in a grasped and lifted position.

An additional object of the instant invention is to provide a gripping apparatus which may be inserted in an area not accessible to truck like structures to which it is attached.

A further object of the instant invention is to allow the grasping of a pipe-like structure and the retrieving of the structure within close proximity of a truck like apparatus whereupon enhanced lifting capacity may be introduced.

Another object of the instant invention is to allow for adequate mobility to facilitate the grasping of configurated pipe-like structures from any position.

An additional object of the instant invention is to allow its attachment to a diversity of forklift like apparatus and other civil engineering vehicles.

These together with other objects of the invention, along with the various features of novelty which characterize the invention, are pointed out with particularity in the claims annexed to and forming a part oft his disclosure. For a better understanding of the invention, its operating advantages and the specific objects attained by its uses, reference would be had to the accompanying drawings, depictions and descriptive matter in which there is illustrated preferred embodiments and results of the invention.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

Figure 1:
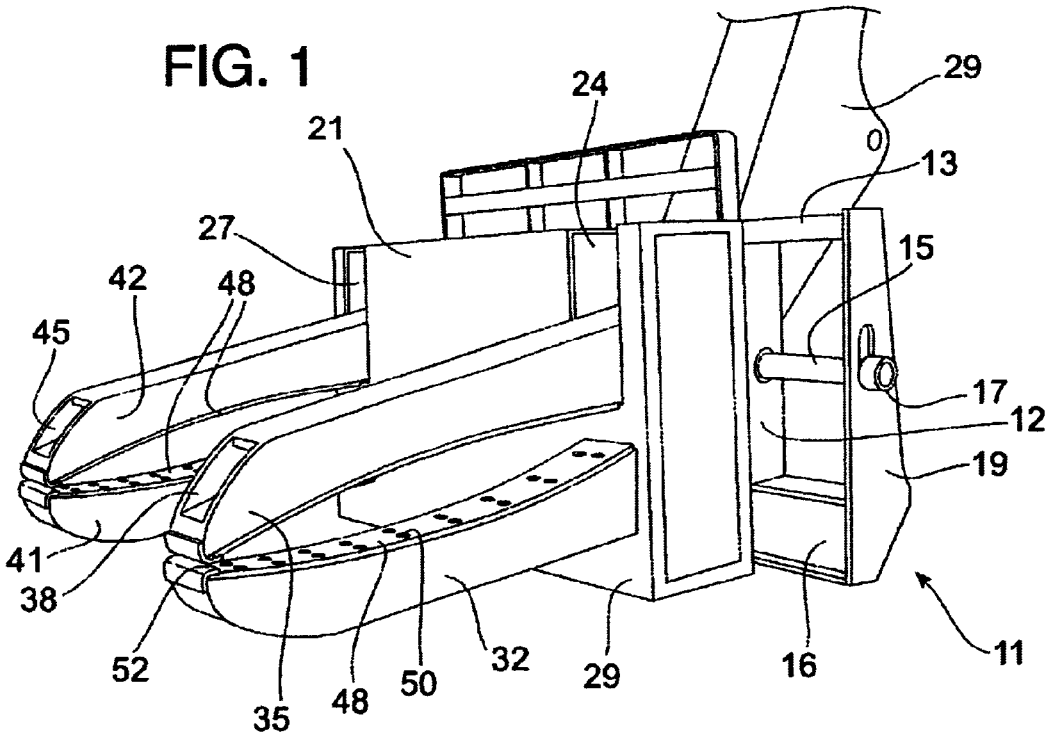
FIG. 1 is a plan view illustration of the instant invention showing its side and front features, as well as a partial view of a civil engineering vehicle's accessory accommodation base.

FIG. 1 illustrates a plain view illustration of the instant invention showing its side and front features, as well as a partial view of a civil engineering vehicle's accessory accommodation base.

In FIG. 1 an accessory accommodation base 11 is shown consisting of an upper support member 13, a bottom support member 16, a left support member 19, an intermediate support member 12, a pivot bar 15, and a pivot bar securing means 17.

The accessory accommodation base 11 is typically attached to a engineering vehicle boom 29 which allows for upward and downward movement of the attached accessory accommodation base 11 via a hydraulic cylinder means (illustrated as element 40, FIG. 2) well-known and practiced by those skilled in the art. The accessory accommodation base 11 also embodies a right support member which is not shown in FIG. 1, but is illustrated and discussed as element 20 in association with FIG. 2.

Continuing with FIG. 1, FIG. 1 further illustrates the invention's jaw housing 21. Formed within said jaw housing 21, are the invention's left upper jaw mobility channel 24 and right upper jaw mobility channel 27. Said channels (24, 27) allowing for the independent upward and downward movement of the invention's upper left jaw 35 and upper right jaw 42. The invention's upward and downward movement of said jaws 35 and 42 facilitated via connection of each upper jaw to a hydraulic cylinder which shall be discussed and disclosed further in association with FIG. 3.

In FIG. 1, the lower left jaw 32 and lower right jaw 41 member are shown and respectively complement said upper left and right jaw members (35, 42) to jointly create a radially accommodating concave shaped gripping structure sufficient to grasp and retain cylindrically shaped configurated pipe-like structures. Each of said jaw members 41, 42, 32, and 35 have further attached to their innermost surface, a compressible non-slip gripping surface 48. This compressible gripping surface 48, in experimentation has shown to be most effectively embodied as a rubber compound, such as, but not limited to, those products marked as "super Rhino", Urethane with a Durometer hardness/compressibly factor of '80'. This compressible gripping surface 48 is attached via a plurality of means, such as, although not limited to, bolt and nut structures 50 or other similarly intended affixation means. Element 52 of FIG. 1 illustrates a retaining clasp which folds over the forward edge of the previously described compressible surface 48 to further preclude the said gripping surface's 48 ability to slip or otherwise move in an undesired forward direction when grasping, transporting, or positioning of individual or configurated pipe-like structures. It is to be noted that each of the previously described jaw members 32, 35, 42, and 41 have incorporated-therein said retaining clamp. The retaining clamp 52 can be a separate structure which may be bolted or welded to each jaw member formed as a continuation of a the body of said jaw members so as to perform the retaining clamp function as previously described.

Figure 2:
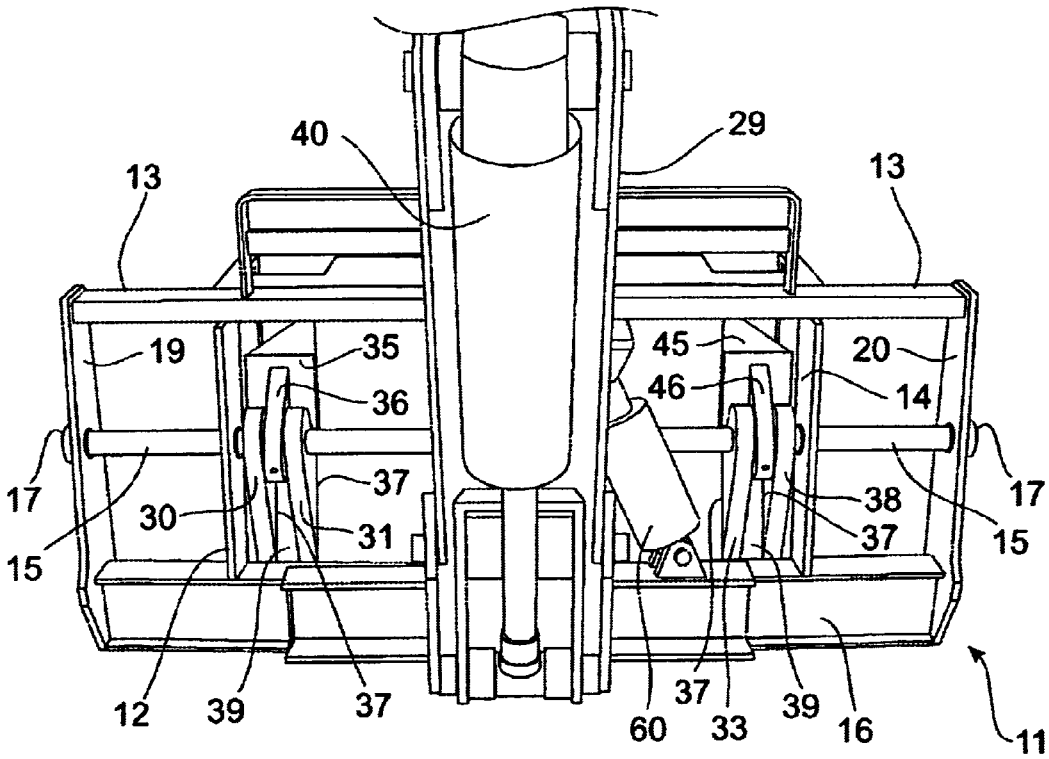
FIG. 2 is an illustration of the instant invention from the rear looking forward.

FIG. 2 illustrates a view of the instant invention from the rear looking forward. Turning now to FIG. 2.

In FIG. 2, the invention's intermediate support members 12 and 14, as well as right and left support members (19, 20) may be better observed. Also observed in FIG. 2, is the invention's pivot bar 15 which is positioned horizontally across the accessory accommodation base 11 and extends through openings in each of the invention's intermediate support members (12, 14), central support members (not shown), as well as the invention's left support member 19 and right support member 20. A pivot bar securing means 17 is also disclosed with said securing means 17 is one of many readily known and practiced securing means known to those skilled in the art which may be used to prevent said pivot bar's rotation, such as welding, locking pin.

Continuing with FIG. 2, third hydraulic cylinder 60 is disclosed attached to the invention's bottom support member 16 and top support member 13 in such a manner so as to allow a left/right inclined orientation of said accessory accommodation base 11 whenever said cylinder's rod is extended or retrieved. FIG. 2 also shows an upward left jaw connecting member 36 of the upper left jaw 35. Said connecting member 36 attached to the pivot bar 15 via insertion of said pivot bar through an opening in said connecting member 36. Also associated with the connecting member 36, are first and second left side braces (30, 31) which, via an opening included therein, accommodate a passage therethrough of said pivot bar 15 with a second surface of said braces 37 immovably attached to a brace support wall 39 via welding or other permanently securing means.

It is also be observed that the invention further discloses in FIG. 2 a like connection of the invention's upper right jaw 42 via an upper right jaw jaw connection means 46 supported by a first right side brace 33 and a second right side brace 38. Said braces 33 and 38 and upper right jaw connection means 46 structure in a matter duplicate of that discussed and disclosed in association with the instant invention'supper left jaw 35 and brace (30, 31) connections, having openings created therein to accommodate the passage through of said pivot bar 15 and welds, or other permanent structures to attach said braces to the invention's brace support wall indicated as element 35 in FIG. 2.

Figure 2A:
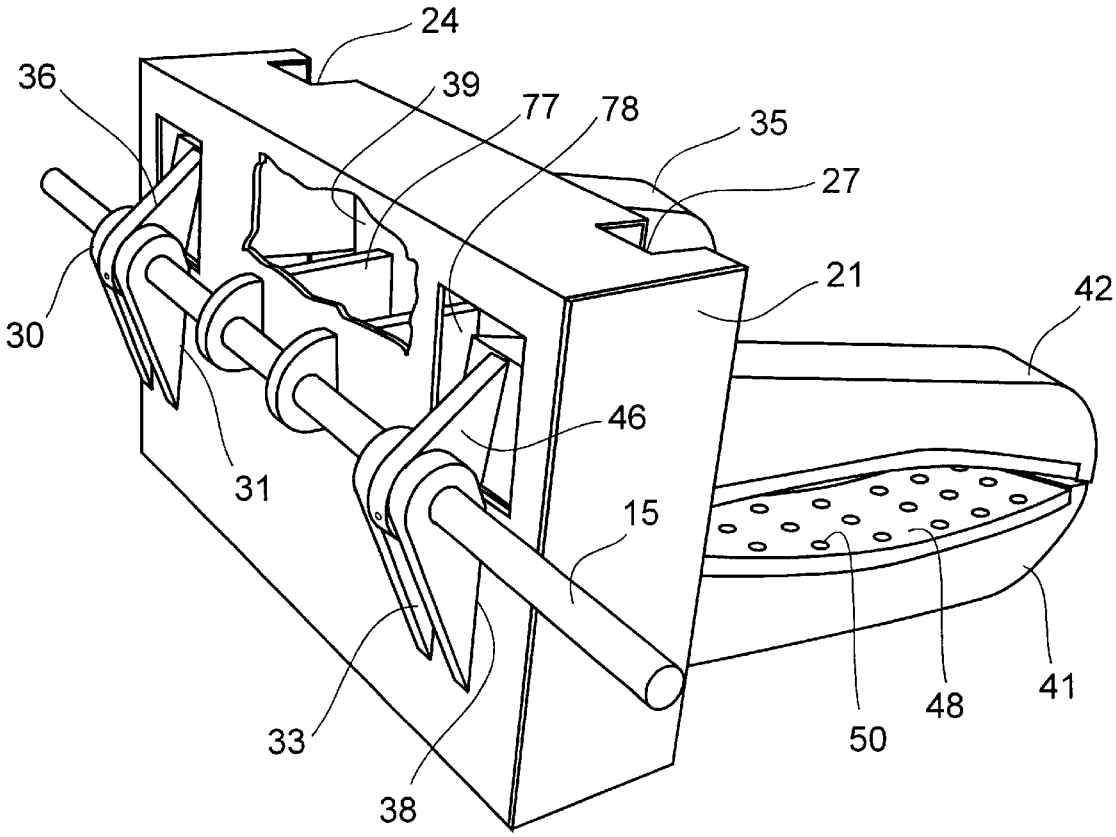
FIG. 2A is a plan view illustration of the invention showing its rear and side features.

FIG. 2A is a plan view illustration of the instant invention showing its rear and side features. In FIG. 2A, the central support members 77 and 78 are shown immovably attached to brace support wall 39 via welding or other permanently securing means. First and second left side braces (30, 31) are also shown as are first right side brace 33 and second right side brace 38. Said left and right braces, as well as central support members 77 and 78, each containing apertures through which the pivot bar 15 of the instant invention may be inserted through to allow manipulation of upper right jaw member 42 and upper left jaw member 35 (not shown). Said manipulation of said upper arms facilitated by a pivotal connection of an upper right jaw connection means 46, and an upper left jaw connection means 36.

Figure 3:
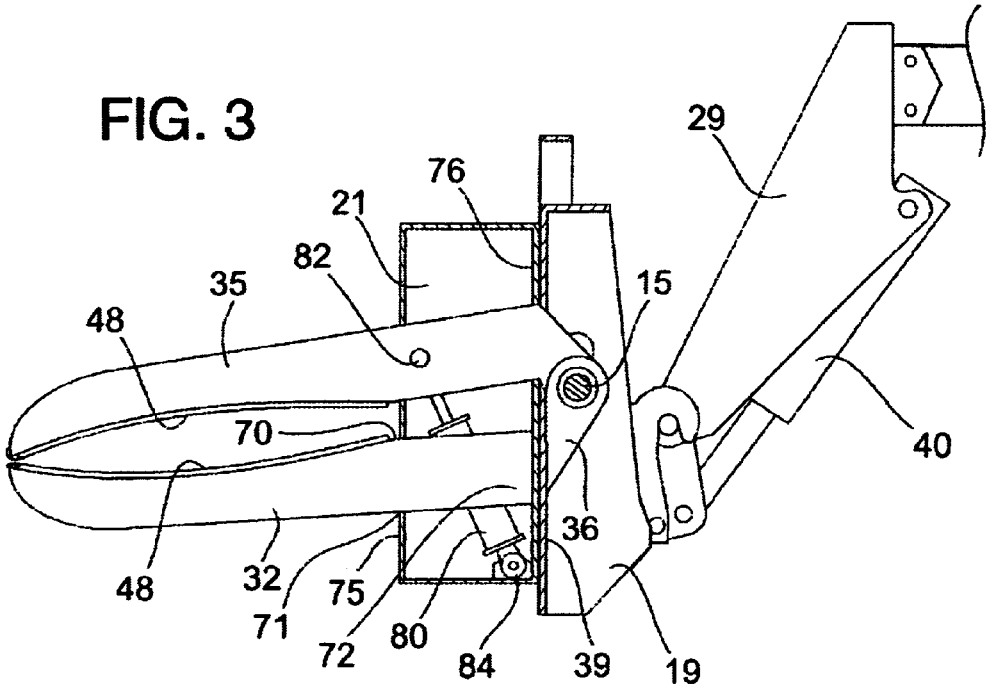
FIG. 3 is a side view illustration of the instant invention further illustrating the invention's upper and lower jaw connections and hydraulic cylinders attached thereto.

FIG. 3 illustrates a side view illustration of the instant invention further illustrating upper and lower jaw connections and hydraulic cylinder attached thereto. It is noted both left and right jaw pairs are similarly attached. Turning now to FIG. 3.

In FIG. 3, a pair of left and right jaw members upper and lower (Left=32 and 35 jaw members, right=41 and 42 jaw members not illustrated in FIG. 3). Each of said pair of jaw members (32, 35, 41, and 42) are concave shaped with the upper jaw member pivotally attached to pivot bar 15. Each lower jaw member is further comprised of upper 70, lower 71, left 72, and right side (not shown) surfaces, with the upper 70 and lower 71 surfaces immovably attached to a first lower jaw attachment wall 75, and said left 72 and right (not shown) surfaces immovably attached to a second lower jaw attachment wall 76. That is, the upper and lower most surfaces of said lower jaw are inserted through the first lower jaw attachment wall 75 and welded or otherwise permanently attached to the second lower jaw support wall 76.

In FIG. 3, first hydraulic cylinder 80 is shown pivotally 82 attached to said upper left jaw and a base typically the lower most surface of the invention's jaw housing 84. Actuation. (i.e. extension/retrieval) of the invention's hydraulic cylinder rod allows for the upward or downward movement of said upper jaw member 35 via upper jaw mobility channels (not shown) disclosed in association with FIG. 1. FIG. 3 also provides additional detail with respect to the positioning and placement of braces 35 of the instant invention shown pivotally attached to the pivot bar and immovably attached to brace support wall 39.

Continuing with FIG. 3, the invention's compressible gripping surface 48 is illustrated as attached to the lower most surface of the invention's upper jaw member 35 and the upper most surface of the lower jaw member 32.

Figure 4:
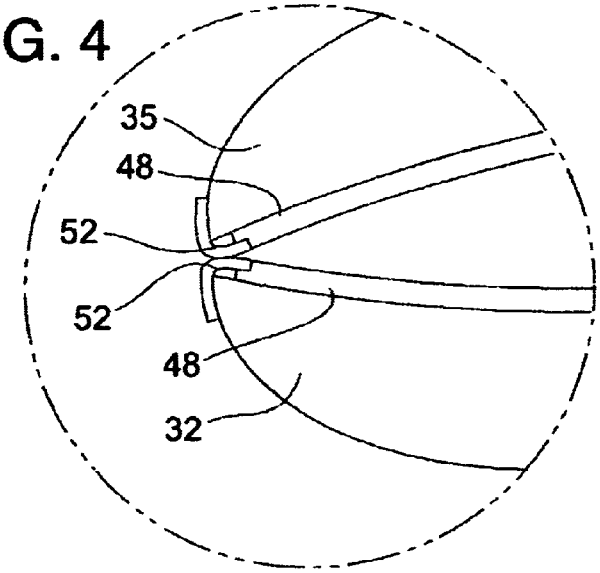
FIG. 4 is a close up illustration of the instant invention showing further detail of the invention's gripping surface's retainer clips.
Figure 5:
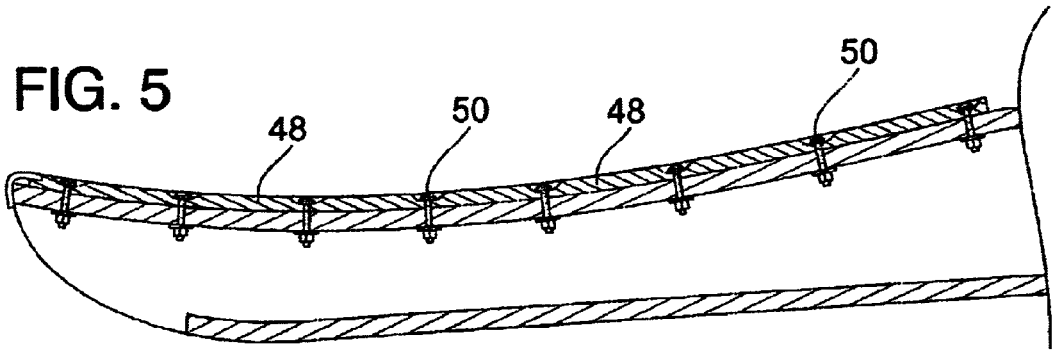
FIG. 5 is a cross-sectional view of a lower jaw of the instant invention showing greater detail with respect to the attachment of the instant invention's compressible gripping surface.

In FIG. 4, it is shown the retaining clamp structures 52 of the instant invention are shown as continuous in form to encompass or otherwise clamp the compressible gripping surfaces 48 of said lower jaw 49 and upper jaw members 45 (illustratively disclosed as elements 32 and 35 respectively but indicative of all jaw members otherwise described via element numbers 32, 35, 41, and 42 herein). FIG. 5 illustrates further detail with respect to the attachment of said compressible gripping surface 48 to said jaw members 49 and 50. Turning now to FIG. 5.

In FIG. 5, the compressible gripping surface 48 is shown inserted within retaining claim 52 and bolted or otherwise secured to an upper or lower jaw member. For purposes of complete and clear disclosure, said attachment is shown utilizing bolt like structures 50 extending through said compressible material and upper most surface jaw member. It is to be noted that an exact or equivalent means of attaching said compressible surface is used in association with all jaw member affixing said compressible surface to said jaw members concave shaped upper or lower most surface.

FIGS. 6A through 6D illustrate the instant invention when connected to a civil engineering vehicle further illustrating: (a) the instant invention's retrieval of an individual or configurated pipe-like structure, (b) an upward tilting of the instant invention after said pipe-like structure has been grasped by the invention, (c) a further increase in the angle of the instant invention when carrying the pipe-like structure as precipitated by a civil engineering vehicle boom movement, and (d) an upward angling of the instant invention precipitated so exclusively by the tilting capability introduced by a civil engineering vehicle hydraulic cylinder. Turning now to FIG. 6.

Figure 6A:
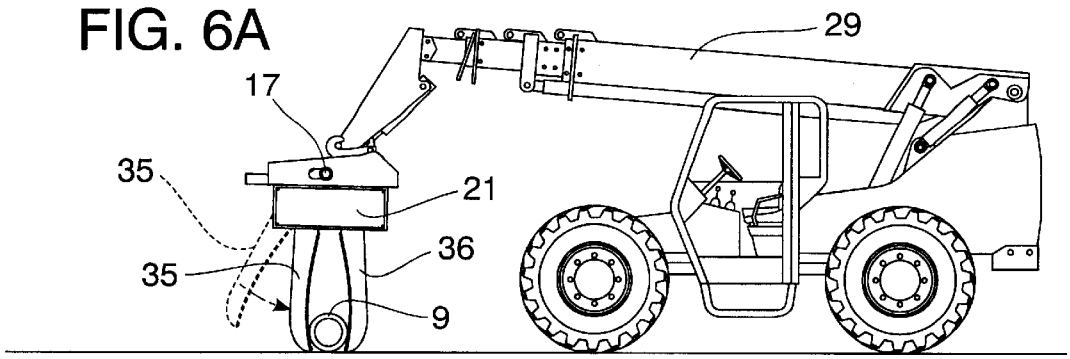
FIGS. 6A through 6D are illustrations of the instant invention when connected to a civil engineering vehicle further illustrating: (a) the instant invention's retrieval of an individual or configurated pipe-like structure, (b) an upward tilting of the instant invention after said pipe-like structure has been grasped by the invention, (c) a further increase in the angle of the instant invention when carrying a pipe-like structure as precipitated by a civil engineering vehicle boom movement, and (d) an upward angling of the instant invention precipitated so exclusively by the tilting capability introduced by a civil engineering vehicle hydraulic cylinder.

In FIG. 6A, the invention is shown having actuated its first or second hydraulic cylinder such that said cylinders' movement precipitates the closure or downward member of an upper jaw member to cause an individual or configurated pipe-like structure to be drawn into or placed within the space provided between said upper and lower jaw members. Said hydraulic pressure continues to be introduced until the compressible gripping surface of the instant invention allows for secure grasp of said pipe-like structure. Without so limiting, in practice it has been shown through repeated experimentation that a hydraulic cylinder working in conjunction with each of said jaw pairs and exerting between 2,000 and 2,500 PSI has proved most effective to retrieving and transporting individual or configurated pipe-like structures between 1 and 75 feet in length and weighing between 1 and 8,000 pounds. However, no such limitations are to be construed via the repeated experimentation. As disclosed, it would be readily apparent to those skilled in the art that modified dimensioning of the invention, such as but not limited to, increasing or decreasing radial arches, increase or decrease dimensioning of the invention's jaw pair lengths with commensurate increase or decrease in hydraulic cylinders' PSI would allow for enhanced low bearing and positioning. As would be further apparent to those skilled in the art, independent manipulation of the invention's first or second hydraulic cylinders could be accommodated simply by adding a second hydraulic line and control mechanism.

Figure 6B:
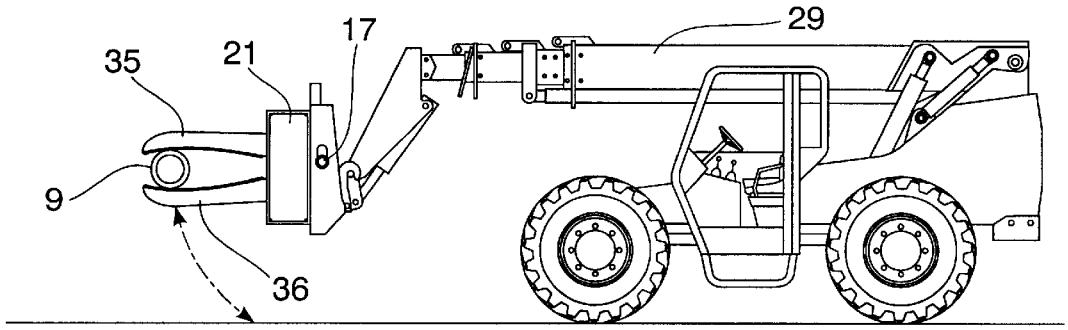

After having secured placement within the upper and lower jaw members of each jaw pair, FIG. 6B illustrates a preliminary transport position of said configurated pipe-like structures precipitating movement of a hydraulic means commonly associated with boom like structures associated with, although not limited to, forklift like vehicles. The extending of said cylinder downward allows for the pivoting of the invention's modified accessory accommodation base in an upward manner, herein shown roughly as 90° from absolute vertical to horizontal.

Figure 6C:
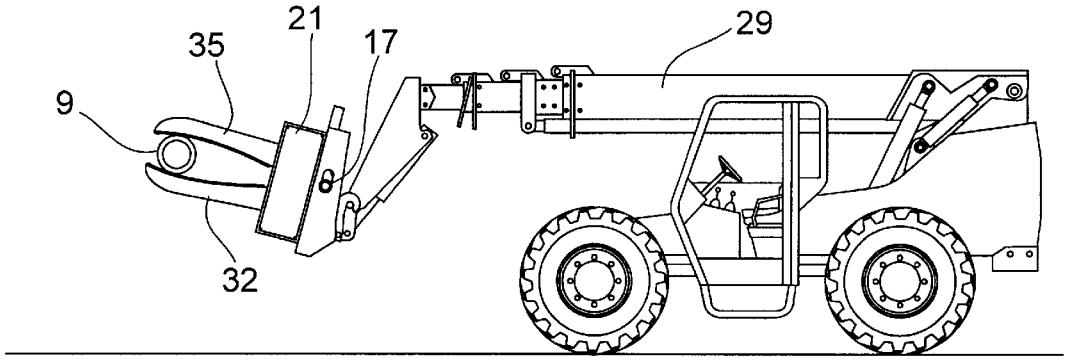

FIG. 6C shows the apparatus of the instant invention having been tilted upward from absolute vertical to a degree angle of approximately 110° to allow for said gravity to assist the secure clamping and transport of said pipe-like structure absent the necessity of relying upon elevation of said boom like structure.

Figure 6D:
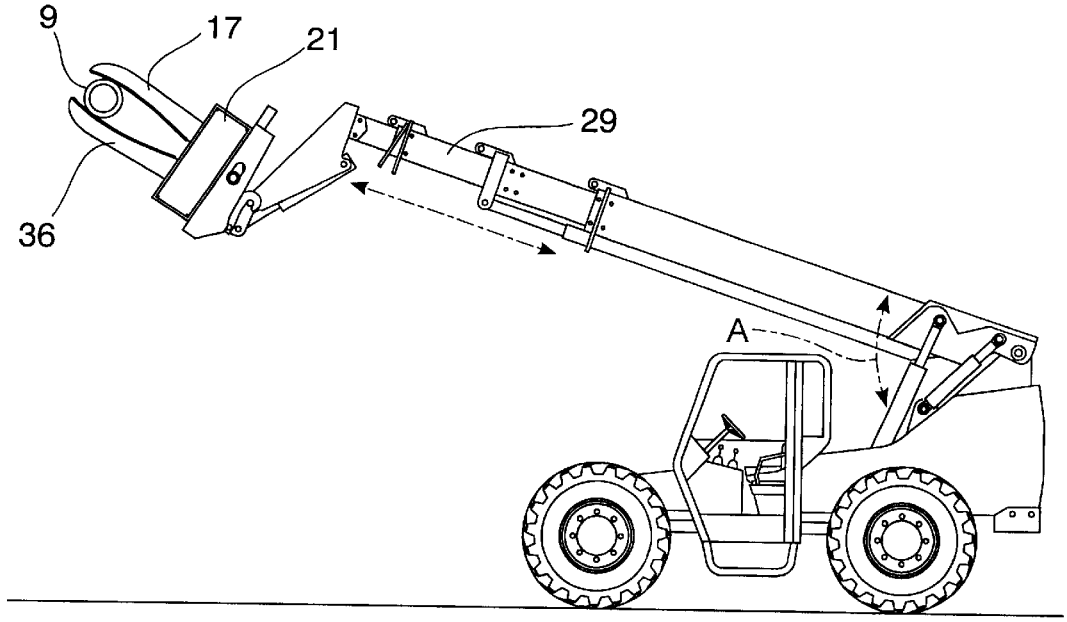

FIG. 6D illustrates a further tilting apparatus of the instant invention utilizing the boom like structure of the vehicle to which said accessory accommodation base has been attached. By moving the boom like structure in an upward movement in direction A, the angle of the jaws clamped upon the pipe-like structure is thereby increased allowing for gravity to further assist in the secure and transport of said pipe-like structure.

Figure 7:
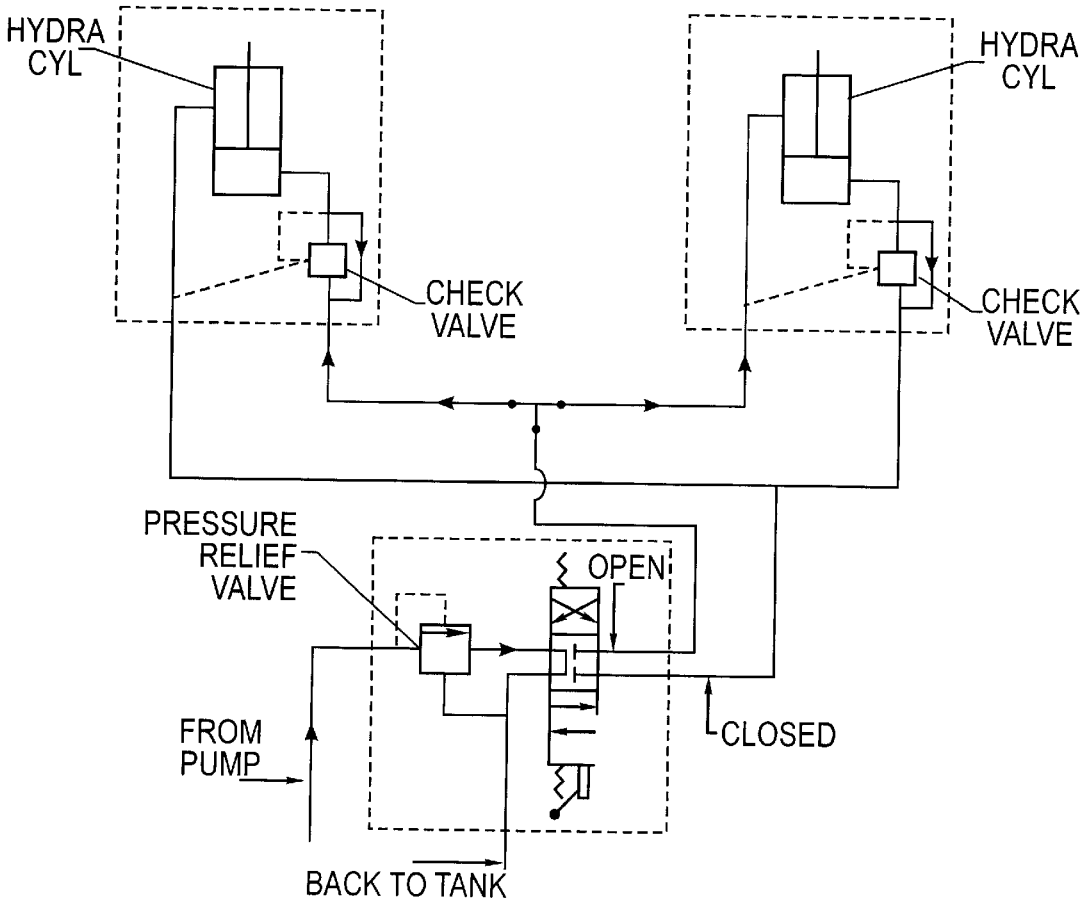
FIG. 7 is an illustrative/descriptive diagram of the instant invention's hydraulic system.

FIG. 7 illustrates a self defining hydraulic schematic of the instant invention where it is shown that the use of check valves in association with each of the hydraulic cylinders used to precipitate independent movement and clamping capability of upper and lower jaw members associated with each clamping pair. As will be readily apparent to those skilled in the art individual manipulation of either right or left jaw members could be readily facilitated via installation of a second (independent) hydraulic line to each manipulative jaw member actuated hydraulic means.

While the invention has been described with a certain degree of particularity, it is clear that many changes may be made in the details of construction and the arrangement of components without departing from the spirit and scope oft his disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In combination with a vehicle having an accessory accommodation base to which devices are removably attachable, a gripping apparatus comprising:

an accessory accommodation base having connected top, bottom, left, right, intermediate support members;

a brace support wall attached to said accessory accommodation base;

an pivot bar positioned horizontally across said accessory accommodation base and extending through openings in said left and right and intermediate support members;

a jaw housing having connected first and second lower jaw weld walls, top, bottom, left and right members;

concaved shaped left and right upper jaw members each pivotally attached to said pivot bar;

concaved shaped left and right lower jaw members each having upper, lower, left and right side surfaces, said upper and lower surfaces immovably attached to a first lower jaw attachment wall and said left and right surfaces immovably attached to a second lower jaw attachment wall;

a lower right jaw brace impermanently attached to said pivot bar and immovably attached to said brace support wall;

at least one lower left jaw brace impermanently attached to said pivot bar and immovably attached to said brace support wall;

a first hydraulic cylinder attached to said upper left jaw and an internal lower jaw housing surface; and, a second hydraulic cylinder attached to said upper right jaw and an internal lower jaw housing surface.

2. The device of claim 1 further comprising a plurality of a lower right jaw braces impermanently attached to said pivot bar and immovably attached to said brace support wall.

3. The device of claim 1 further comprising a plurality of a lower left jaw braces impermanently attached to said pivot bar and immovably attached to said brace support wall.

4. The device of claim 1 further comprising of a plurality of central support members impermanently attached to said pivot bar and immovably attached to said brace support wall.

5. The device of claim 1 wherein said lower right jaw brace comprises first and second lower right jaw braces impermanently attached to said pivot bar and immovably attached to said brace support wall, said first right brace positioned on a first side of said upper right jaw pivotal connection and said second brace positioned on a second side of said pivotal connection.

6. The device of claim 1 wherein said at least one lower jaw brace comprises first and second lower left jaw braces impermanently attached to said pivot bar and immovably attached to said brace support wall, said first left brace positioned on a first side of said upper left jaw pivotal connection and said second brace positioned on a second side of said left upper jaw pivotal connection.

7. The device of claim 1 wherein said accessory accommodation base further comprises a plurality of intermediate support members.

8. The device of claim 1 further comprising of distinct and individual hydraulic means attached to each of said left and right upper jaw members allowing for individual manipulation thereof.

* * * * *